US007515863B2

(12) United States Patent
Kato

(10) Patent No.: US 7,515,863 B2
(45) Date of Patent: Apr. 7, 2009

(54) CLEANING UNIT AND IMAGE FORMING APPARATUS USING THE SAME

(75) Inventor: Masahiko Kato, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 138 days.

(21) Appl. No.: 11/544,553

(22) Filed: Oct. 10, 2006

(65) Prior Publication Data

US 2007/0092316 A1 Apr. 26, 2007

(30) Foreign Application Priority Data

Oct. 21, 2005 (JP) ..... 2005-307602

(51) Int. Cl.
*G03G 21/00* (2006.01)

(52) U.S. Cl. ..... 399/350

(58) Field of Classification Search ..... 399/71, 399/117, 123, 343, 350, 351
See application file for complete search history.

(56) References Cited

U.S. PATENT DOCUMENTS 4,576,468 A * 3/1986 Saito ..... 399/351
6,832,067 B2 * 12/2004 Kubo ..... 399/350
7,116,927 B2 * 10/2006 Choi ..... 399/117
7,313,343 B2 * 12/2007 Tanaka et al. ..... 399/123

FOREIGN PATENT DOCUMENTS

| | | |
|---|---|---|
| JP | 60-23874 | 2/1985 |
| JP | 9-222826 | 8/1997 |
| JP | 10-333385 | 12/1998 |
| JP | 11-184307 | 7/1999 |
| JP | 2003-177583 | 6/2003 |
| JP | 2004-287360 | 10/2004 |

* cited by examiner

*Primary Examiner*—Sandra L Brase
(74) *Attorney, Agent, or Firm*—Oblon, Spivak, McClelland, Maier & Neustadt, P.C.

(57) ABSTRACT

A cleaning unit for an image forming apparatus of the present invention includes removing means made up of a cleaning blade configured to remove toner particles left on the surface of an image carrier in contact with the image carrier and a blade holder holding the cleaning blade. Assuming that the cleaning blade has a natural frequency of fc and that the image carrier has a speed variation frequency of fd ascribable to rotation thereof, a range other than a range represented by the following relation is selected:

$$\frac{1}{\sqrt{2}} \cdot f_c < f_d < \sqrt{2} \cdot f_c.$$

9 Claims, 8 Drawing Sheets

SPECTRUM

CLEANING UNIT AND IMAGE FORMING APPARATUS USING THE SAME

BACKGROUND OF THE INVENTION

1. Field of the Invention

The present invention relates to a copier, facsimile apparatus, printer or similar image forming apparatus and more particularly to a cleaning unit configured to reduce the degradation of image quality and noise ascribable to vibration that occurs between a cleaning blade and a photoconductive body or image carrier included in an image forming apparatus for thereby achieving a stable cleaning characteristic.

2. Description of the Background Art

A problem with a cleaning unit included in an image forming apparatus is that stick-slip occurs due to friction acting between a cleaning blade and a photoconductive drum or similar image carrier. Vibration ascribable to the stick-slip constitutes a vibration source causing the image carrier to produce noise or is propagated from the cleaning blade to a unit casing to also produce noise. Because a cleaning unit is essential for removing residual toner left on an image carrier after image transfer, it is necessary to reduce such noise.

Further, if relative vibration between the cleaning blade and the image carrier increases, load acting on the drive of the image carrier varies due to the friction of the cleaning blade. As a result, speed variation is aggravated to bring about banding or similar degradation of image quality. Banding refers to a phenomenon that the density of an output image varies in accordance with the frequency of speed variation, lowering image quality. Such a phenomenon is ascribable to an increase in the speed variation of the image carrier mentioned above.

Moreover, when the cleaning blade vibrates due to resonance, a gap is sometimes formed between the image carrier and the edge of the cleaning blade. If the gap is sized greater than toner particles, then toner particles are allowed to pass through the gap and make cleaning defective.

In order to solve the problems stated above, Japanese Patent Laid-Open Publication No. 10-333385, for example, discloses a color image forming apparatus including driving devices against which an image carrier and an intermediate image transfer body are pressed and to which torque is transmitted from a double shaft, double gear motor via gear trains. This color image forming apparatus is characterized in that a dynamic damper or a flywheel is mounted on the motor shaft in order to control the amplification of vibration ascribable to the resonance of the motor. With this configuration, according to the above document, it is possible to reduce the vibration of the image carrier for thereby protecting a latent image formed on the image carrier from disturbance.

Japanese Patent Laid-Open Publication No. 9-222826 teaches that the inertia masses of inertia members, which are included in a rotation driveline, and the numbers of rotations and the numbers of teeth of gears are so selected as to confine the frequency of eccentricity of a rotation driver implemented by gears and the frequency of speed variation based on the meshing of gears in the attenuation range in the frequency response of a rotation driving device. This is successful to prevent the vibration of an apparatus from being amplified.

The problem with the prior art technologies stated above is that vibration is controlled on the basis of the configuration of a driving device, e.g., a dynamic damper or a flywheel or the numbers of teeth or the rotation speeds of gears. As a result, when the number of structural parts, including the dynamic damper or the flywheel and gears, increases, the number of conditions for controlling vibration increases and make the entire configuration sophisticated and bulky.

Technologies relating to the present invention are also disclosed in, e.g., Japanese Patent Laid-Open Publication Nos. 60-023874, 11-184307 and 2003-177583.

SUMMARY OF THE INVENTION

It is an object of the present invention to provide a cleaning device capable of preventing relative vibration between an image carrier and a cleaning blade from being amplified by the vibration characteristic of the cleaning blade with a simple configuration and a process cartridge, an image forming apparatus and a color image forming apparatus using the same.

A cleaning unit for an image forming apparatus of the present invention includes removing means made up of a cleaning blade configured to remove toner particles left on the surface of an image carrier in contact with the image carrier and a blade holder holding the cleaning blade. Assuming that the cleaning blade has a natural frequency of $f_c$ and that the image carrier has a speed variation frequency of $f_d$ ascribable to rotation thereof, a range represented by the following relation is selected:

$$\frac{1}{\sqrt{2}} \cdot f_c \geq f_d \geq \sqrt{2} \cdot f_c$$

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
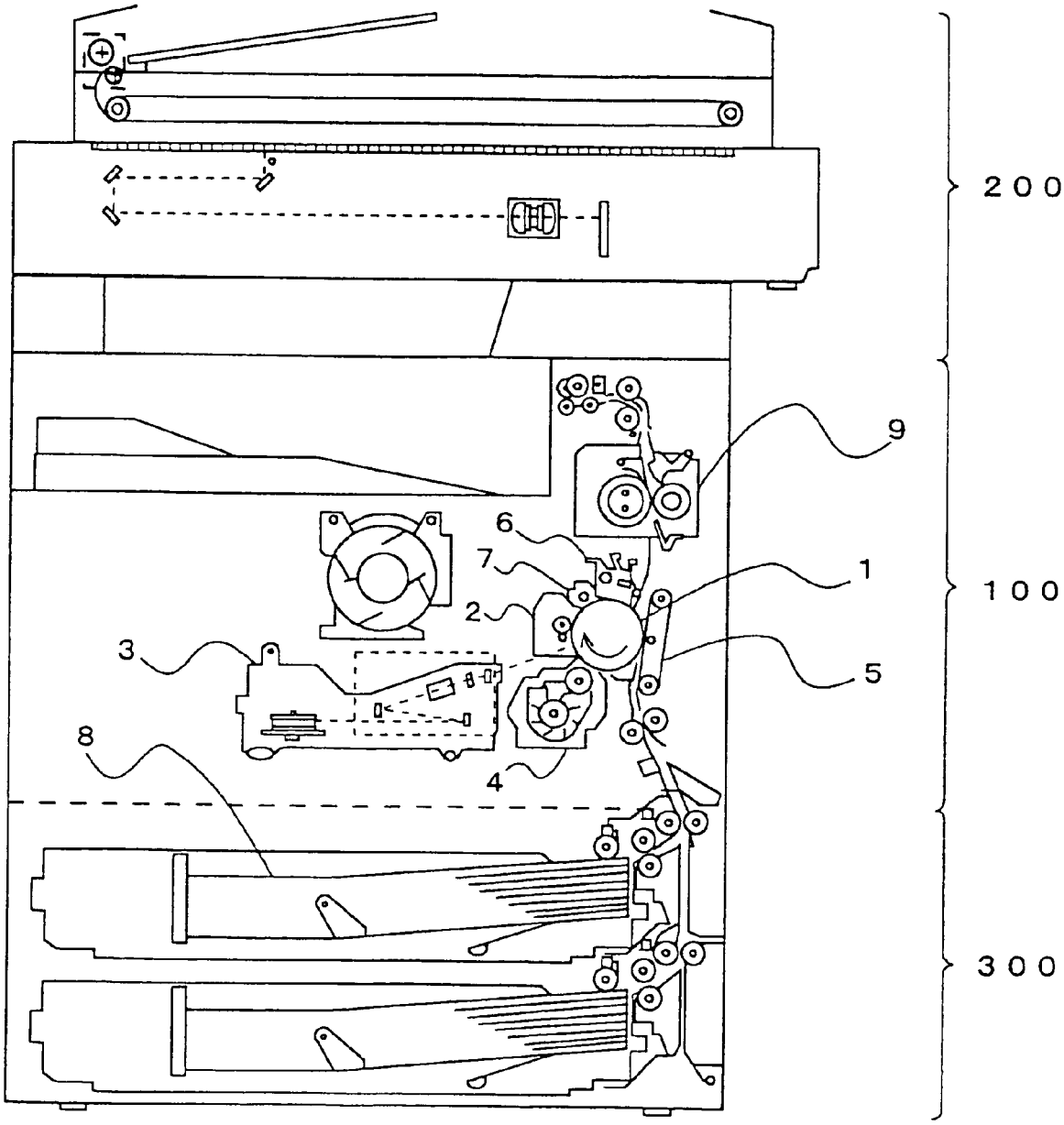
FIG. 1 is a view conceptually showing an image forming apparatus including a cleaning unit embodying the present invention.

Referring to FIG. 1 of the drawings, an image forming apparatus embodying the present invention is shown. As shown, the image forming apparatus is generally made up of an image forming section 100, an image reading or scanning section 200 and a sheet feeding section 300.

The operation of the image forming apparatus shown in FIG. 1 will be briefly described hereinafter. After a desired document has been set by an operator on an ADF (Automatic Document Feeder) included in the image reading section 200 or on a glass platen, the image forming apparatus is operated to cause the image reading section 200 to read the image of the document with a light source, mirrors, a focusing lens and a CCD (Charge Coupled Device) image sensor or similar image sensor. The resulting image data are sent from the image reading section 200 to the image forming section 100.

A sheet or recording medium 8 is conveyed from a sheet tray included in the sheet feeding section 300 to the image forming section 100 via a preselected sheet transport path. When the sheet is brought to a position where a photoconductive drum or image carrier 1 and an image transferring unit 5 are held in contact with each other, an image is transferred from the drum 1 to the sheet in accordance with the above image data. Subsequently, the sheet, carrying the image thereon, is conveyed to a fixing unit 9 to have the image fixed thereon and then driven out to a stacking portion.

Figure 2:
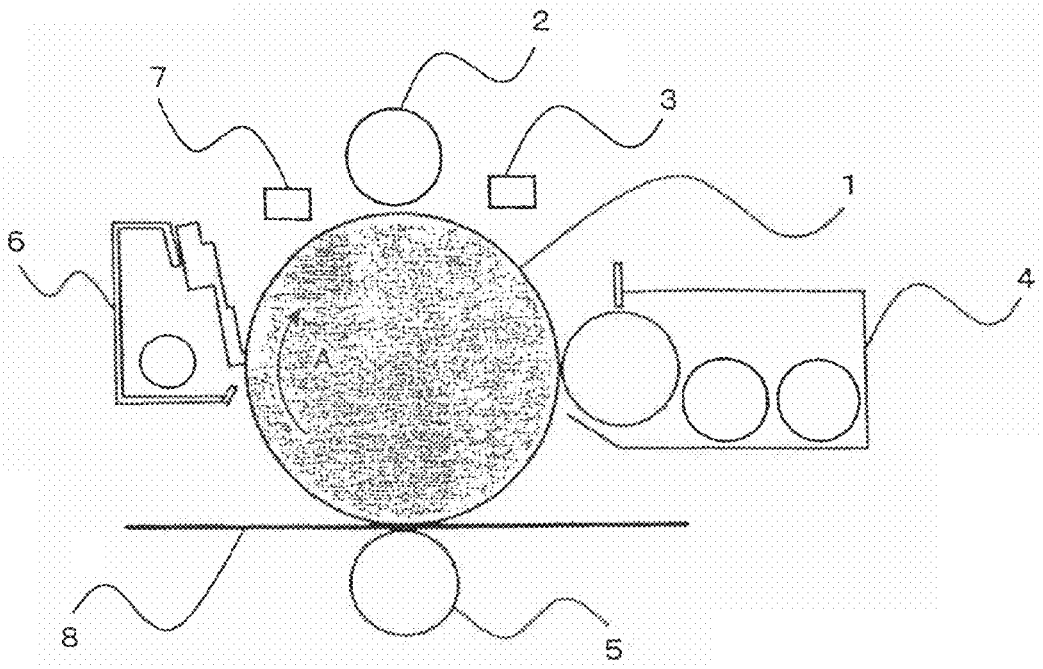
FIG. 2 is a view showing the cleaning unit together with various units associated therewith.

FIG. 2 conceptually shows a cleaning unit in accordance with the illustrative embodiment together with various members associated therewith. As shown, the photoconductive drum (simply drum hereinafter) 1, a charger 2, an exposing unit 3, a developing unit 4, an image transferring unit 5, and a discharger 7 are arranged in the vicinity of the cleaning unit 6. The charger 2, exposing unit 3, developing unit 4, image transferring unit 5, cleaning unit 6 and discharger 7 are arranged around the drum 1, which is rotatable in a direction indicated by an arrow A in FIG. 1. The fixing unit 9, FIG. 1, is adapted to fix a toner image transferred from the drum 1 to the sheet 8.

The charger 2, contacting the surface of the drum 1 or adjoining it at a preselected distance, is configured to uniformly charge the drum 1 to a preselected potential of preselected polarity. The exposing unit 3 scans the surface of the drum 1 thus charged with light emitted from a light source in accordance with the image data representative of the document image, which is read by the document reading section 200, thereby forming a latent image on the above surface. The light source maybe implemented by an LD (Laser Diode) or an LED (Light Emitting Diode) array by way of example.

The developing unit 4 includes a rotatable sleeve or developer carrier and a magnet roller fixed in place in the sleeve and is configured to cause a developer to deposit on the sleeve. In the illustrative embodiment, use is made of a two-component type developer made up of toner particles produced by mixing and dispersing a colorant in thermoplastic resin and then powdering the resulting dispersed mixture and carrier particles implemented by, e.g., powdery glass beads or iron powder. With such a developer, the developing unit 4 performs magnet brush type of development. Of course, the two-component type developer may be replaced with a single component type developer consisting only of toner particles. A voltage is applied from a bias power supply to the sleeve in order to cause charged toner to deposit on the latent image formed on the drum 1 in a developing region on the basis of a difference between the bias applied to the sleeve and the potential of the latent image, thereby forming a toner image.

The image transferring unit 5 is pressed against the surface of the drum 1 by preselected pressure in the event of image transfer while being applied with a preselected voltage, transferring the toner image from the drum 1 to the sheet 8 at the nip between the drum 1 and the image transferring unit 5. While the image transferring unit 5 is implemented by an image transfer roller in the illustrative embodiment, it may alternatively be implemented by a corotron charger, image transfer belt or similar image transferring means.

The discharger 7 discharges the surface of the drum 1 from which residual toner has been removed by the cleaning unit 6 after the image transfer. In the illustrative embodiment, use is made of an optical discharging system using, e.g., LEDs.

The cleaning unit 6 includes a vibration member and a blade member. The blade member is pressed against the surface of the drum 1 in order to remove residual toner left on the drum 1. The toner thus removed from the drum 1 is conveyed to a waste toner bottle, not shown, by a toner conveying member as waste toner. Thereafter, the waste toner is collected by, e.g., a service person or again conveyed to the developing section 4 as recycled toner to be reused.

Figure 9:
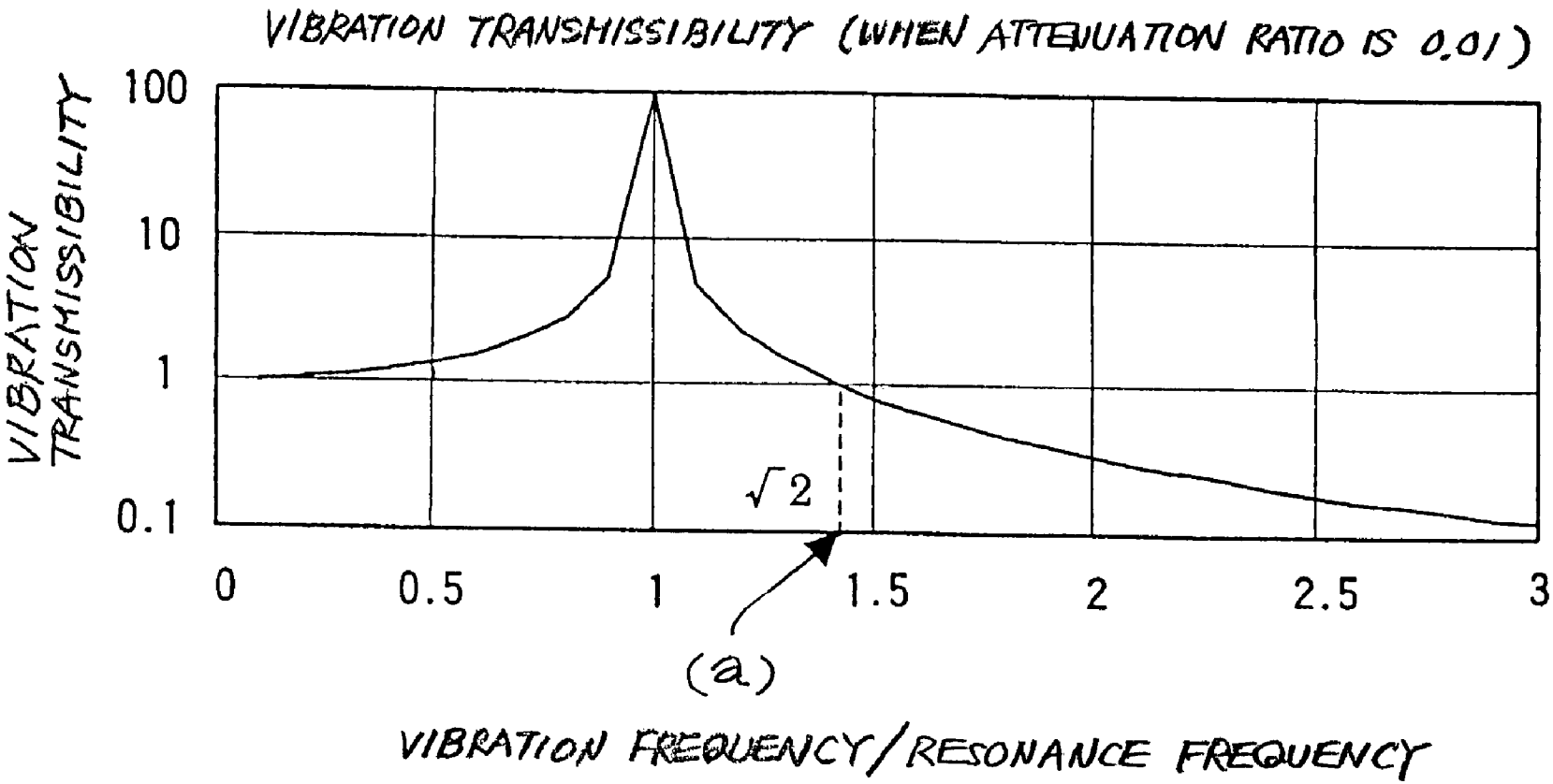
FIG. 9 PRIOR ART
FIG. 9 is a graph showing a specific variation of vibration transmissibility of a conventional image forming apparatus.

FIG. 9 is a graph showing a specific variation of conventional vibration transmissibility. As shown, when the vibration frequency/resonance frequency ratio is "1", meaning that the two frequencies are coincident with each other, the vibration transmissibility is maximum, i.e., vibration becomes great. On the other hand, when the vibration frequency/resonance frequency ratio is greater than a range above a point indicated by an arrow (a) in FIG. 9, the vibration transmissibility decreases below "1", meaning that vibration decreases.

Assuming that the cleaning blade has a natural frequency of $f_c$ and that the speed variation frequency of the drum 1 is $f_d$, the following expression holds:

$$\frac{1}{\sqrt{2}} \cdot f_c < f_d < \sqrt{2} \cdot f_c \tag{1}$$

When the relation between the drum 1 and the cleaning blade is considered, the speed variation frequency $f_d$ of the drum 1 and the natural frequency $f_c$ of the cleaning blade correspond to the vibration frequency and resonance frequency, respectively. It follows that the frequency band represented by the expression (1) is noticeably susceptible to resonance and therefore disturbs the behavior of the cleaning blade due to vibration. As one of the resulting phenomena, the cleaning blade brings about slip-stick to thereby increase relative vibration between itself and the drum 1. Consequently, the drum 1 is caused to vibrate by the cleaning blade and makes its surface turn into an acoustic radiation surface that generates noise.

As another phenomenon, there increases the variation of friction acting between the cleaning blade and the drum 1 with the result that torque, causing the drum 1 to rotate, fluctuates and lowers image quality. Further, the vibration causes toner particles left on the drum 1 to get by the cleaning blade, making cleaning defective. In addition, it is likely that the edge of the cleaning blade is damaged due to the increase in the frequency of vibration.

To avoid the various phenomena stated above, the cleaning unit 6 of the illustrative embodiment is configured to select a frequency band represented by the expression:

$$\frac{1}{\sqrt{2}} \cdot f_c \geq f_d \geq \sqrt{2} \cdot f_c$$

This successfully prevents the friction ascribable to the relative speed variation between the cleaning blade, which may constitute a vibration source, and the drum 1 from being amplified by the resonance of the cleaning blade, thereby realizing a low noise, high image quality configuration. Further, defective cleaning ascribable to the vibration, which is amplified by an increase in the resonance of the cleaning blade, is reduced. In addition, the edge of the cleaning blade is protected from deterioration otherwise occurring at the early stage of operation.

Figure 3:
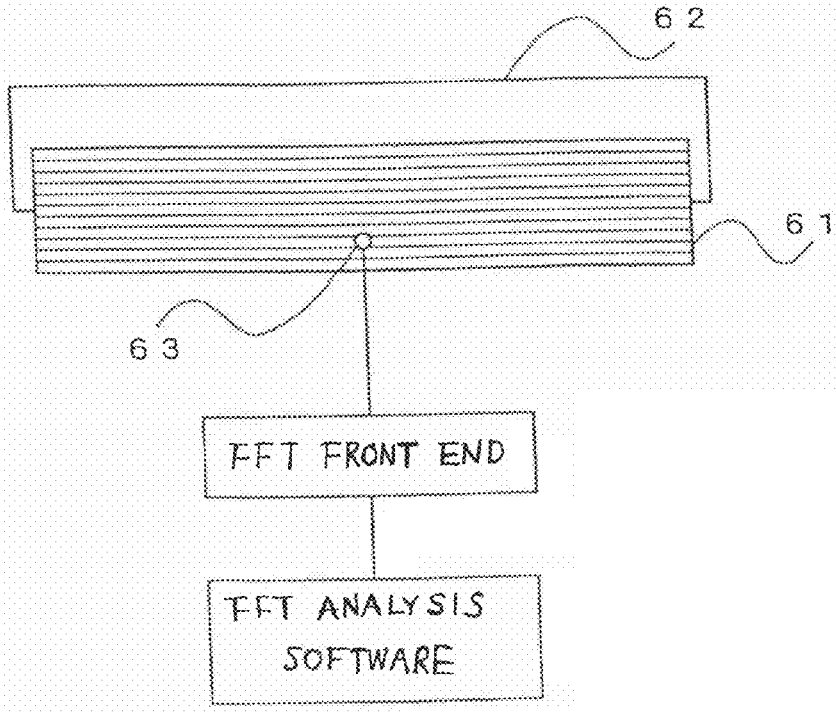
FIG. 3 is a view conceptually showing a specific arrangement for measuring acceleration vibration particular to the cleaning device.

FIG. 3 shows a specific arrangement used for actually measuring the vibration of the cleaning blade that occurs during cleaning. As shown, in the illustrative embodiment, the cleaning unit includes a cleaning blade 61 and a blade holder 62 holding the cleaning blade 61. For measurement, a miniature, IPC type acceleration pickup 63, which was about 0.5 g heavy, was connected at one end to a position on the cleaning blade 61 about 5 mm away from the center of the edge in order to measure acceleration oscillation. The other end of the acceleration pickup 63 was connected to the front end of an FFT (Fast Fourier Transform) analyzer, so that time-series acceleration oscillation was determined by signal analyzing software on a PC (Personal Computer). More specifically, offset canceling procedure was executed with the resulting acceleration data and followed by two times of integration, thereby converting the acceleration data to displacement data.

Figure 4:
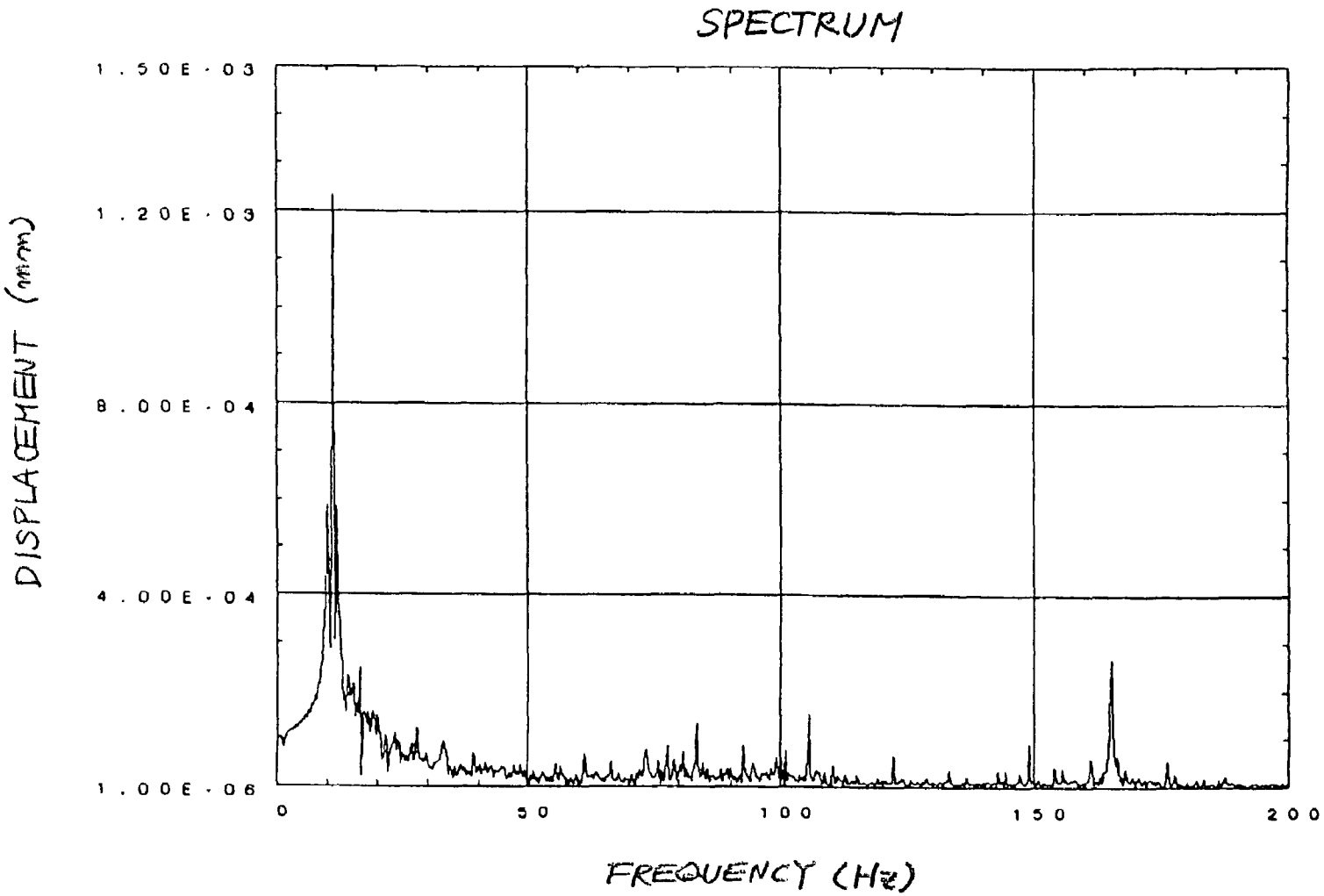
FIG. 4 is a graph showing a specific frequency distribution of displacement data.

FIG. 4 is a graph showing a specific variation of the acceleration data thus obtained with the above arrangement. In FIG. 4, the highest peak of about 10.5 Hz is representative of the rotation frequency of a motor adapted to drive the drum. Among the other peaks, a peak close to about 105 Hz is representative of a meshing frequency determined by the rotation speed of the above motor and gears constituting a drive transmission line. Further, a peak close to about 165 Hz is representative of a meshing frequency determined by the rotation speed of a motor assigned to the sleeve of the developing unit and gears constituting a drive transmission line.

Figure 5:
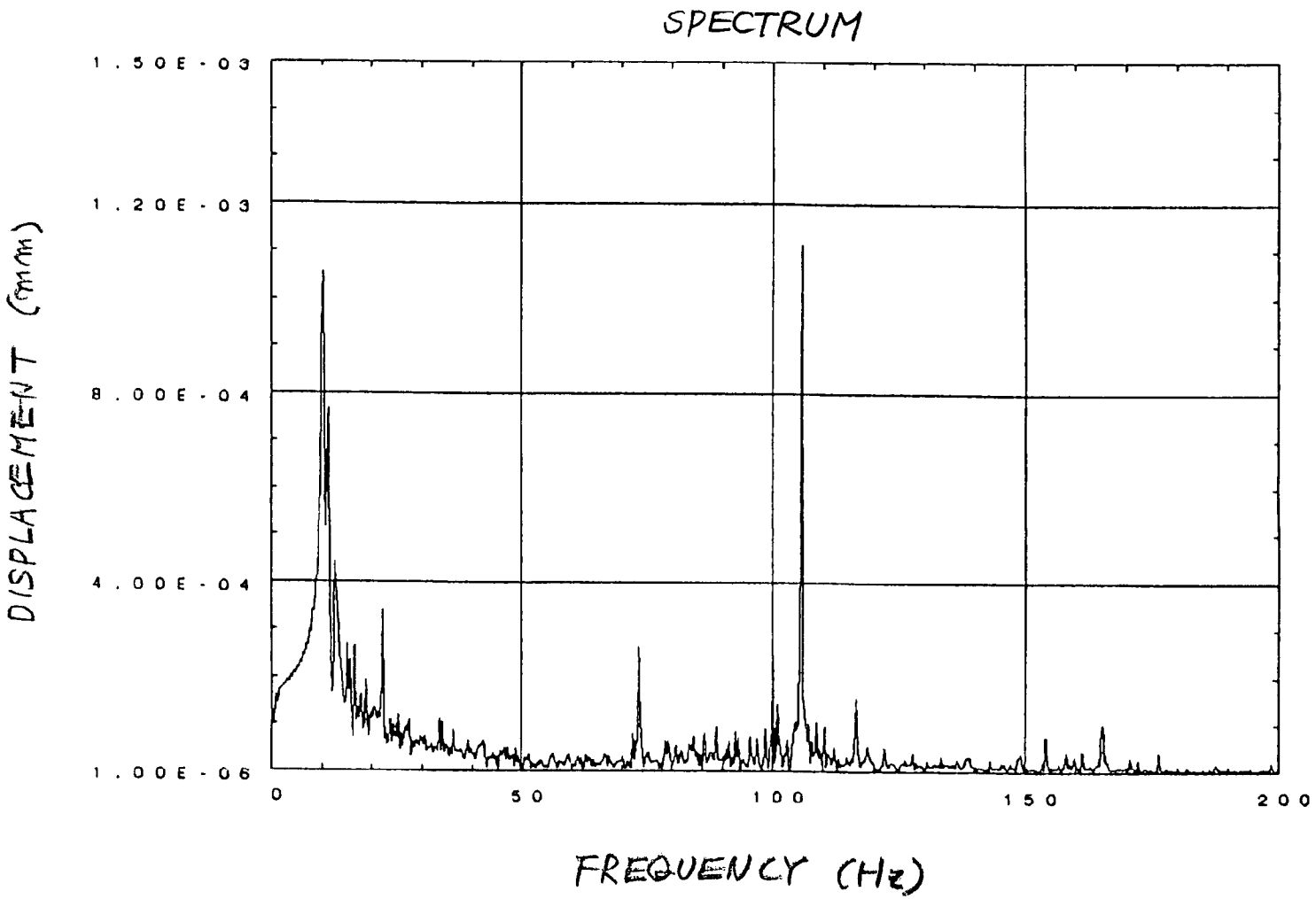
FIG. 5 is a graph showing data obtained with the cleaning device when use was made of a cleaning blade having natural frequency of about 105 Hz.

FIG. 5 is a graph showing data obtained when analysis was executed with a cleaning blade having a natural frequency of 105 Hz and the arrangement described with reference to FIG. 3. As shown, the cleaning blade greatly resonated in accordance with the variation at the frequency of about 105 Hz which was particular to the drum as a speed variation frequency, increasing the amplitude of the vibration. Besides, the speed variation of the drum is aggravated due to an increase in the contact and friction of the cleaning blade. Consequently, when images are output by use of the cleaning blade whose natural frequency is about 105 Hz, the influence of banding is conspicuous.

Further, when the relative speed variation between the drum and the cleaning blade occurs, the vibration force acting on the drum also increases at the same time as banding, again making the surface of the drum to turn into an acoustic radiation surface and therefore aggravating noise.

Moreover, when the vibration of the cleaning blade increases, a gap is sometimes formed between the cleaning blade and the drum and allows toner particles to pass therethrough. Toner grains thus passed through the above gap without being collected by the cleaning blade would cause smears or other defects to appear in images. In addition, an increase in vibration would cause a strong frictional force to act on the edge of the cleaning blade, resulting in the deterioration of the cleaning blade in the early stage of operation.

The above results of measurements are based on a meshing frequency determined by a relation between the rotation frequency of the drum drive motor and gears constituting a drive transmission line and the natural frequency of the cleaning blade. The same results were obtained even when use was made of a meshing frequency determined by a relation between, e.g., the rotation speed of the sleeve drive motor and gears constituting a drive transmission line and the natural frequency of the cleaning blade. It will thus be seen that the vibration frequency of the cleaning blade should be selected in a range outside of the range represented by the expression (1) and susceptible to the influence of resonance.

To vary natural frequency particular to the cleaning blade, there may be varied, e.g., the thickness, the width or the length of the blade holder, which is one of structural parameters of the cleaning unit, or the position where the cleaning blade is affixed or the number of such positions. By adequately selecting any one of such parameters, i.e., selecting a range outside of the frequency band represented by the expression (1), it is possible to provide a cleaning unit enhancing image quality, producing a minimum of noise and having high durability.

As stated above, in the cleaning unit in accordance with the illustrative embodiment, the speed variation frequency $f_d$ included in the expression (1) is equal to the meshing frequency of the rotation frequency of the drum drive motor adapted to vary the speed of the drum and the gears or the meshing frequency of the rotation frequency of the sleeve drive motor and the gears. Therefore, the frequencies stated previously are not amplified by the vibration characteristic of the cleaning blade, so that there can be obviated noise ascribable to the rotation frequency and meshing frequency and the degradation of image quality ascribable to banding.

Further, in the illustrative embodiment, natural frequency may alternatively be varied by varying the material of the blade holder. This will be described hereinafter on the assumption that plastics is applied to the blade holder.

Figure 6:
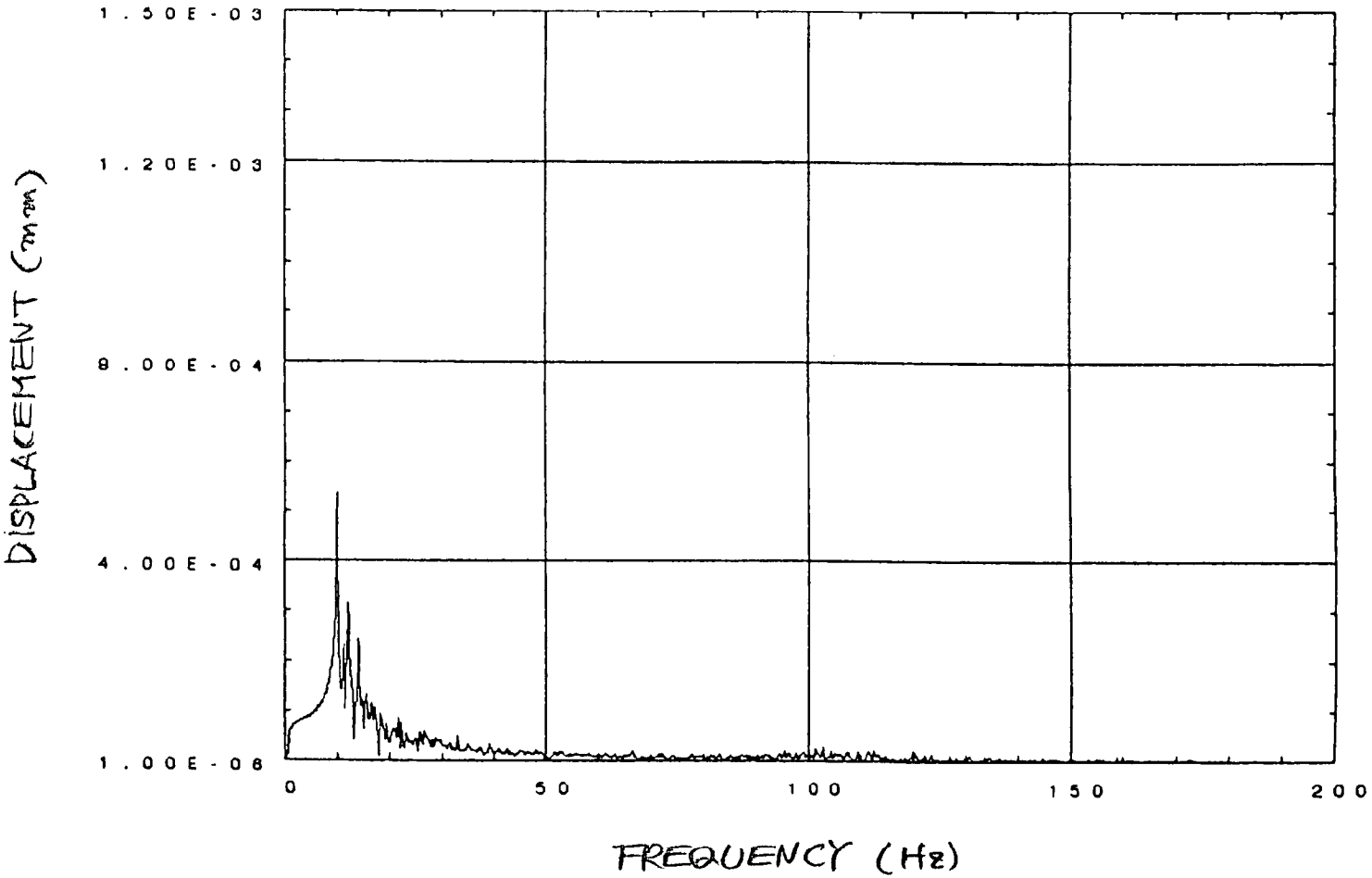
FIG. 6 is a graph showing data obtained with the cleaning device when a blade holder was made of ABS resin.

FIG. 6 is a graph showing vibration data obtained when the blade holder of the cleaning unit was made of plastics and analysis was executed with the arrangement of FIG. 3. It is to be noted that the blade holder subjected to the analysis of FIG. 6 was made of ABS resin with which a glass material was mixed for higher rigidity. By applying ABS resin to the blade holder, it is possible to further enhance the attenuation characteristic of the cleaning blade.

By comparing FIG. 6 with FIG. 4, it will be seen that the attenuation characteristic of the blade holder thus enhanced caused the vibration of the cleaning blade to decrease and that ABS resin applied to the blade holder was successful to reduce vibration based on the speed variation of the drum and therefore to implement desirable image quality.

As stated above, when the cleaning blade of the cleaning unit in accordance with the illustrative embodiment is made of ABS resin or similar non-metallic material having a great attenuation effect, the frictional force ascribable to the cleaning blade, which may constitute a vibration source, and the speed variation of the drum is prevented from being increased due to the resonance of the cleaning blade. In addition, the attenuation characteristic derived from the vibration characteristic of the blade holder allows the relative vibration between the cleaning blade and the drum to be further reduced, further reducing noise and enhancing image quality.

ABS resin is, of course, only an exemplary material applicable to the cleaning blade and may be replaced with any other resin so long as it has a high attenuation characteristic.

Figure 7:
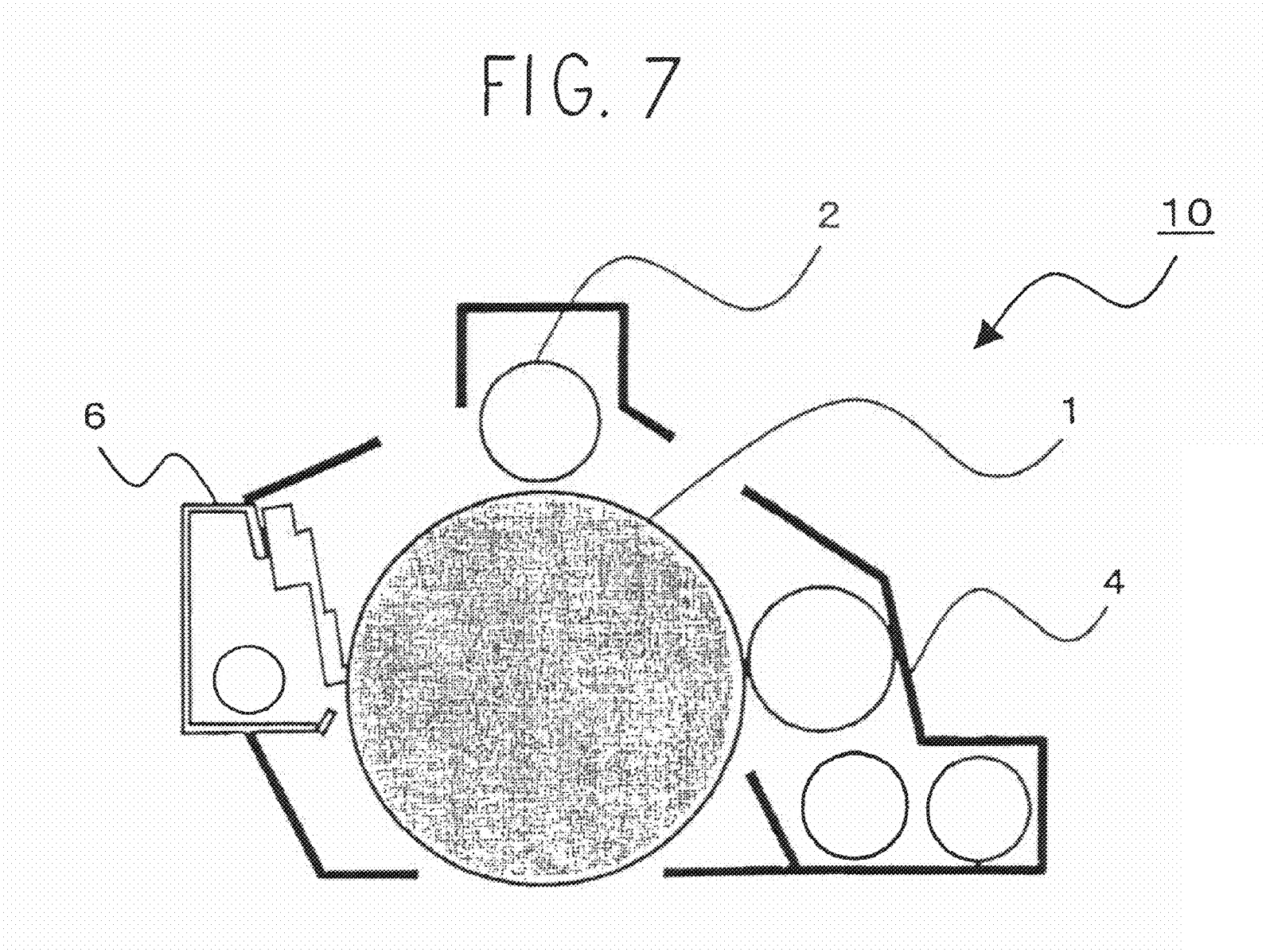
FIG. 7 is a view showing a process cartridge to which the cleaning device is applied.

A process cartridge including the cleaning unit of the illustrative embodiment will be described with reference to FIG. 7. As shown, the drum 1, charger 2, developing unit 4 and cleaning unit 6 shown in FIG. 3 are constructed into a single process cartridge 10, which is removably mounted to the apparatus body of a copier, printer or similar image forming apparatus.

By arranging the cleaning unit 6 of the illustrative embodiment in the process cartridge 10 removable from the apparatus body, i.e., by constructing the cleaning unit 6 and the drum 1, charger 2 and developing unit 4 into a single process cartridge 10, it is possible to reduce defective cleaning ascribable to the speed variation of the drum 1 and to enhance image quality and reduce noise by reducing vibration. Further, the process cartridge is easy to replace and therefore promotes easy maintenance and can even be bodily replaced with one included in another image forming apparatus. In addition, the image forming apparatus of the illustrative embodiment, including the above process cartridge 10, is capable of reducing defective cleaning and enhancing image quality and reducing noise with the low-noise configuration.

If desired, a plurality of process cartridges, having the configuration shown in FIG. 7 each, may be applied to a color image forming apparatus in combination, as will be described hereinafter.

Figure 8:
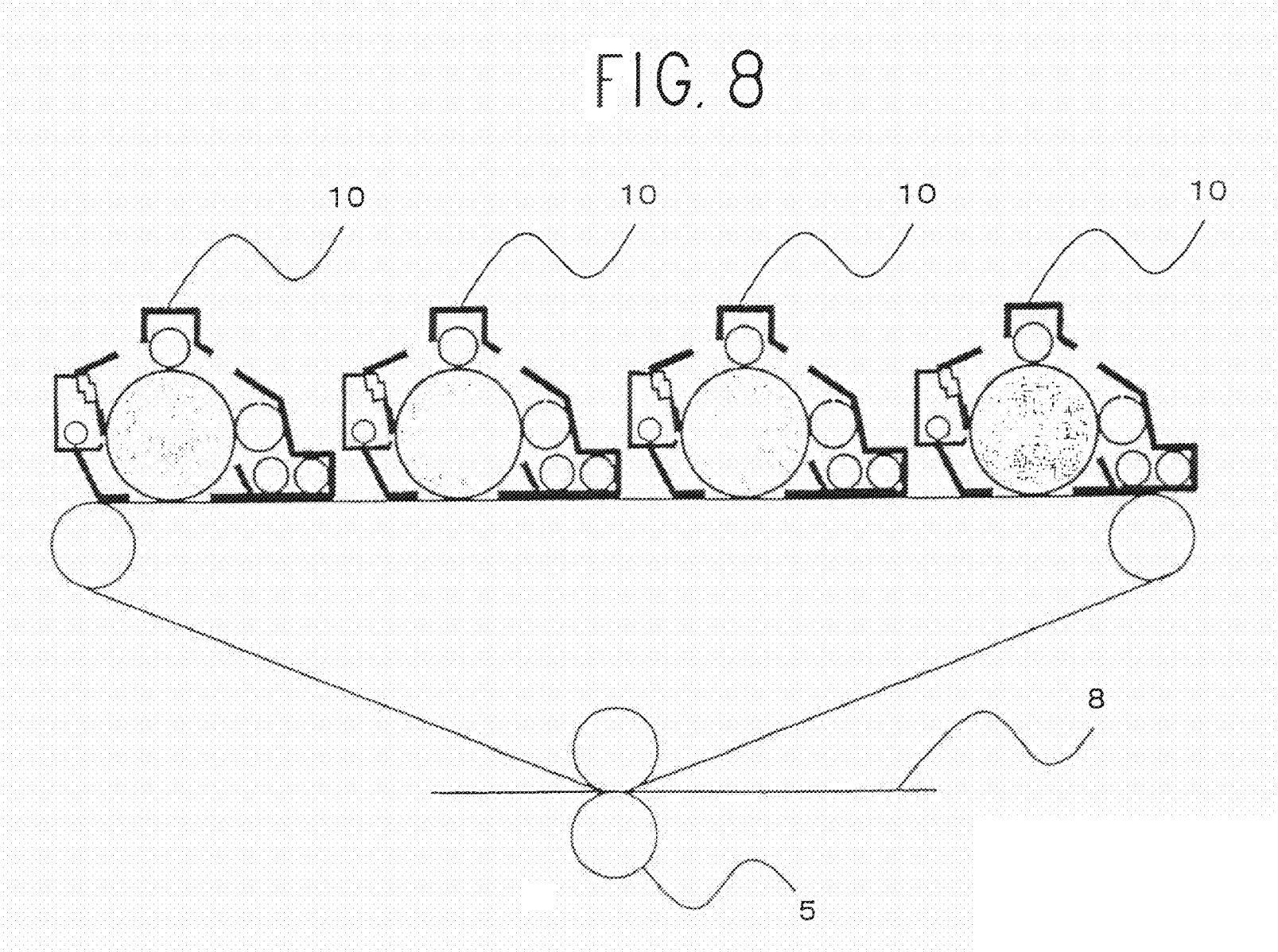
FIG. 8 is a view showing a color image forming apparatus to which the cleaning device is applied.

FIG. 8 shows a specific configuration of a color image forming apparatus including a plurality of process cartridges arranged side by side and each including the cleaning unit of the illustrative embodiment. As shown, four process cartridges 10 assigned to yellow (Y), magenta (M), cyan (C) and black (K), respectively, are included in the color image forming apparatus. Toner images formed on the drums of the process cartridges 10 are sequentially transferred to an intermediate image transfer belt one above the other, completing a color image. Subsequently, the color image is transferred from the intermediate image transfer belt to a sheet or recording medium and then fixed on the sheet by a fixing unit not shown. Of course, the four process cartridges 10 arranged in the order of Y, M, C and K in FIG. 8 may be arranged in any other suitable order.

Usually, the apparatus body of a color image forming apparatus is bulky because of a plurality of image forming sections arranged therein. Furthermore, when any cleaning unit, charger or similar unit fails alone or reaches a time for replacement, extremely time- and labor-consuming work is required for replacement due to the sophisticated construction of the image forming apparatus.

By contrast, the illustrative embodiment, having the drum, charger and developing unit constructed into a single process cartridge together with other units, allows even the user of the image forming apparatus to perform replacement and provides a small size, highly durable color image forming apparatus.

In practice, by suitably arranging the Y, M, C and K process cartridges 10, it is possible to reduce defective cleaning, to enhance image quality and reduce noise by reducing vibration and to promote easy maintenance.

In summary, it will be seen that the present invention provides a cleaning unit capable of preventing relative vibration between a photoconductive drum or image carrier and a cleaning blade from being amplified by the vibration characteristic of the cleaning blade and a process cartridge, an image forming apparatus and a color image forming apparatus each including such a cleaning unit.

Various modifications will become possible for those skilled in the art after receiving the teachings of the present disclosure without departing from the scope thereof.

What is claimed is:

1. A cleaning unit comprising:

a removing device configured to remove toner particles left on a surface of an image carrier, said removing means including a cleaning blade configured to remove the toner particles in contact with the surface of said image carrier and a blade holder holding said cleaning blade, wherein said cleaning blade has a natural frequency of $f_c$ and said image carrier has a speed variation frequency of $f_d$ ascribable to rotation thereof, a range represented by a following relation is selected:

$$\frac{1}{\sqrt{2}} \cdot f_c \geq f_d \geq \sqrt{2} \cdot f_c.$$

2. The cleaning unit as claimed in claim 1, wherein the speed variation frequency includes a rotation frequency relating to rotation of a driver assigned to said image carrier.

3. The cleaning unit as claimed in claim 2, wherein the speed variation frequency includes a meshing frequency based on said rotation frequency and a gear constituting a drive transmission line assigned to said image carrier.

4. The cleaning unit as claimed in claim 1,wherein the speed variation frequency includes a rotation frequency relating to rotation of a driver assigned to a developing unit, which is configured to develop a latent image formed on the surface of said image carrier.

5. The cleaning unit as claimed in claim 4, wherein the speed variation frequency includes a meshing frequency based on said rotation frequency and a gear constituting a drive transmission line assigned to said image carrier.

6. The cleaning unit as claimed in claim 1, wherein said blade holder is formed of a non-metallic material having a high attenuation characteristic.

7. A process cartridge comprising:

a cleaning unit, said cleaning unit includes removing means for removing toner particles left on a surface of an image carrier and including a cleaning blade configured to remove the toner particles in contact with the surface of said image carrier and a blade holder holding said cleaning blade, wherein said cleaning blade has a natural frequency of $f_c$ and that said image carrier has a speed variation frequency of $f_d$ ascribable to rotation thereof, a range represented by a following relation is selected:

$$\frac{1}{\sqrt{2}} \cdot f_c \geq f_d \geq \sqrt{2} \cdot f_c.$$

8. An image forming apparatus comprising:

a cleaning unit, said cleaning unit includes removing means for removing toner particles left on a surface of an image carrier and including a cleaning blade configured to remove the toner particles in contact with the surface of said image carrier and a blade holder holding said cleaning blade, wherein said cleaning blade has a natural frequency of $f_c$ and that said image carrier has a speed variation frequency of $f_d$ ascribable to rotation thereof, a range represented by a following relation is selected:

$$\frac{1}{\sqrt{2}} \cdot f_c \geq f_d \geq \sqrt{2} \cdot f_c.$$

9. The apparatus as claimed in claim 8, wherein said apparatus includes a color image forming apparatus including a plurality of process cartridges each including said cleaning unit.

* * * * *